US005717185A

United States Patent [19]

Smith

[11] Patent Number: 5,717,185

[45] Date of Patent: Feb. 10, 1998

[54] OPERATING MECHANISM FOR HIGH VOLTAGE SWITCH

[75] Inventor: Lloyd B. Smith, Bristol, Tenn.

[73] Assignee: Amerace Corporation, Hackettstown, N.J.

[21] Appl. No.: 578,040

[22] Filed: Dec. 26, 1995

[51] Int. Cl.[6] ..... H01H 33/42

[52] U.S. Cl. ..... 218/154; 218/140

[58] Field of Search ..... 200/17 R, 18, 200/400, 401, 302.1, 302.2, 302.3; 218/84, 120, 140, 153, 154, 14, 78

[56] References Cited

U.S. PATENT DOCUMENTS

| | | | |
|---|---|---|---|
| 2,744,984 | 5/1956 | Hults | 200/302.3 |
| 2,794,101 | 5/1957 | Jennings | 218/136 |
| 2,853,584 | 9/1958 | Upton, Jr. | 218/89 |
| 2,870,298 | 1/1959 | Schwager | 218/138 |
| 2,995,639 | 8/1961 | Panerai et al. | 200/302.1 |
| 3,244,015 | 4/1966 | Parris, Jr. | 74/107 |
| 3,471,669 | 10/1969 | Curtis | 200/302.1 |
| 3,597,713 | 8/1971 | McClain et al. | 335/171 |
| 3,787,649 | 1/1974 | Goodwin, Jr. et al. | 218/120 X |
| 3,812,314 | 5/1974 | Nonken | 218/138 |
| 3,941,957 | 3/1976 | Tilman | 200/82 R |
| 3,955,167 | 5/1976 | Kumbera | 337/188 |
| 4,124,790 | 11/1978 | Kumbera et al. | 218/140 |
| 4,152,562 | 5/1979 | Kohler et al. | 200/400 |
| 4,168,414 | 9/1979 | Kumbera et al. | 200/400 X |
| 4,215,253 | 7/1980 | Tilman | 200/82 R |
| 4,230,922 | 10/1980 | Habecker | 200/302.2 |
| 4,283,610 | 8/1981 | Date et al. | 218/12 |
| 4,419,553 | 12/1983 | Ohshita et al. | 218/120 |
| 4,568,804 | 2/1986 | Luehring | 218/138 |
| 4,709,126 | 11/1987 | Miller et al. | 200/83 P |
| 4,877,930 | 10/1989 | Fukuma | 200/302.2 |
| 4,894,497 | 1/1990 | Lycan | 200/83 R |
| 5,216,213 | 6/1993 | Sato | 200/83 R |
| 5,508,487 | 4/1996 | Smith et al. | 218/154 |

*Primary Examiner*—J. R. Scott

*Attorney, Agent, or Firm*—Lerner David Littenberg Krumholz & Mentlik

[57] ABSTRACT

An actuator for a high voltage switch has a bellcrank and a rocker pivotally mounted to a frame and connected to one another by opening and closing springs. The bellcrank is linked to the movable actuating element of a high-voltage switch. During switch closing, a catch holds the bellcrank in it open position while the operator pivots the rocker towards a closed position, thereby stretching the closing spring and storing energy in it, while allowing the opening spring to go slack. When the rocker reaches a closing unlatch position, the bellcrank is released and moves rapidly toward its closed position, thus closing the switch. The opening action is similar. The bellcrank and rocker may cooperatively define channels for constraining the springs.

18 Claims, 4 Drawing Sheets

OPERATING MECHANISM FOR HIGH VOLTAGE SWITCH

This invention relates generally to actuators switches used in electric power systems.

BACKGROUND OF THE INVENTION

High voltage switch assemblies with sub-atmospheric or vacuum type circuit interrupters for electric power circuits and systems are well known in the art, such as is shown in U.S. Pat. Nos. 4,568,804; 3,955,167 and 3,471,669. Encapsulated vacuum type switches or circuit breakers are also known, as is shown in U.S. Pat. Nos. 3,812,314 and 2,870,298.

In such switch assemblies and circuit breakers, a pair of coacting contacts, one fixed and the other movable, are provided for controlling and interrupting current flow. The contacts are provided in a controlled atmosphere contact assembly which also includes a relatively fragile glass or ceramic housing, commonly referred to as a "bottle". The contacts may be housed within the bottle. A metal bellows is typically provided on one end of the bottle, and the movable contact is linked to the inside of the bellows. An operating rod attached to the outside of the bellows can be moved so as to move the movable contact inside the bottle. The interior of the bottle is maintained under a controlled atmosphere, such as air or another gas under a low subatmospheric pressure, to protect the contacts from damage caused by arcing when the contacts are opened and closed. The glass or ceramic wall of the bottle provides a permeation-resistant enclosure which maintains the controlled atmosphere for the life of the device. Even where such a controlled atmosphere is employed, however, the contacts should be moved towards and away from one another rapidly to minimize arcing.

Actuators used to provide such rapid movement must meet several demanding requirements. The actuator must move the movable contact of the switch in a predictable, repeatable manner, with enough force to overcome friction and inertia, and with enough force to close the contacts securely. However, the range of motion of the actuator should be limited and predictable, so that the actuator does not damage the other components of the switch. A high-voltage switch in an electric utility system may remain open or closed for many years. Therefore, the actuator must function reliably when activated by a lineman, even after sitting idle for years. The actuator should also be capable of withstanding exposure to temperature extremes, water and environmental contaminants. It should withstand repeated operation. The actuator should also be manufacturable at reasonable cost. It should also be compact and compatible with the housings utilized for other elements of the switch. These last-mentioned features are particularly important in actuators intended for underground distribution applications.

U.S. Pat. No. 3,471,669 seeks to provide such a switch for underground applications. The switch according to the '669 patent includes a sub-atmospheric or vacuum type controlled atmosphere contact assembly. The contact assembly for the coacting contacts has spaced reinforcing rods about the exterior and is directly encapsulated in a generally waterproof elastic jacket covered by an electrically conductive coating for grounding. A snap acting spring and toggle assembly is disposed inside the jacket and linked to the operating rod of contact assembly. A rotatable shaft of dielectric material extends from the exterior of the jacket to the toggle assembly. Rotation of the shaft actuates the spring and toggle to move the contacts and close or open the circuit. However, the switch described in the '669 patent has not been widely adopted in the art. As reported in Odom et al, Development and Testing of Encapsulated Vacuum Sectionalizing Switch for Underground Distribution (IEEE publication, date unknown), elastomers which are vulcanized under heat and pressure cannot be used readily to the form the housing in the switch design and manufacturing process as shown in the '669 patent.

Certain elastomers vulcanized by heat and pressure are especially useful insulating materials for underground electrical power systems. Elastomers such as EPDM (ethylene propylene diene monomer) combine high dielectric strength with excellent resistance to the effects of ozone and corona discharge and other useful properties. Elastomers molded and vulcanized under heat and pressure, such as EPDM, have been almost universally adopted as materials of construction for the housings used in other underground electrical distribution systems.

The copending, commonly assigned U.S. patent application of Glenn J. Luzzi entitled High Voltage Switches, filed of even date herewith,(the "Luzzi Application") the disclosure of which is incorporated by reference herein, provides an encapsulated switch for use in a high voltage circuit. Switches according to preferred embodiments of the Luzzi Application include a housing made from an elastomeric material, a hollow, preferably tubular dielectric reinforcing element disposed in the housing and in intimate contact with the elastomeric material of the housing and a contact assembly including a bottle having fixed and movable contacts therein disposed in the hollow reinforcing element. The switch may also include a filler material, different from the elastomeric material of the housing, between the bottle and the hollow reinforcing element. The reinforcing element and the filler material effectively isolate the fragile contact assembly from the conditions encountered in molding the housing, while still providing a void-free dielectric structure.

A switch according to preferred embodiments of the Luzzi Application includes an actuating element accessible from the exterior of the housing and linked to the movable contact. Thus, the housing may include a flexible diaphragm with the actuating element extending through it. The switch may further include a driver or actuator for forcibly moving the actuating element.

SUMMARY OF THE INVENTION

One aspect of the present invention provides an actuator suitable for use with high-voltage switches, including those taught in the Luzzi Application and others. An actuator according to this aspect of the present invention includes a driver frame defining a bellcrank pivot axis and a rocker pivot axis parallel to the bellcrank pivot axis but spaced in a rearward direction therefrom. A bellcrank is mounted to the frame for pivoting movement around the bellcrank pivot axis between an open position and a closed position. The bellcrank has an opening-side attachment point and a closing-side attachment point. A rocker is mounted to the frame for pivoting movement around the rocker pivot axis, between a full-open position and a full-closed position, the rocker having an opening-side attachment point and a closing side attachment point.

An opening-side spring is connected between the opening-side attachment points of the rocker and bellcrank, and a closing-side spring is connected between the closing-side attachment points of the rocker and bellcrank. The attachment points are arranged so that the opening-side spring will be deformed to a stressed condition when the rocker is moved toward its full-open position while the bellcrank remains in its closed position, whereas the closing-side spring will be deformed to a stressed condition when the rocker is moved toward its full-closed condition with the bellcrank remaining in the open position.

An opening-side catch is provided for restraining the bellcrank against opening pivotal movement when the bellcrank is in its closed position, and a closing-side catch restrains the bellcrank against closing pivotal movement when the bellcrank is in its open position thereof. The actuator further includes catch release means for disengaging the opening-side catch when the rocker reaches an opening unlatch position close to its full-open position during opening movement thereof and for disengaging the closing-side catch when the rocker reaches a closing unlatch position close to the full-close position during closing movement thereof.

The actuator may further include mounting means for connecting the frame to a body of a high-voltage switch and connecting the bellcrank to an actuating element of the switch. The user actuates the switch by pivoting the rocker. When the rocker pivots in closing movement the closing-side spring will be deformed, and energy will be stored in it, until the rocker reaches the closing unlatch position, and the closing-side catch is disengaged. At that time, the closing-side spring will drive the bellcrank in pivoting movement towards its closed position and drive the actuating element of the switch rapidly toward a closed position thereof. When the rocker pivots in opening movement, the opening-side spring will be deformed, and energy will be stored in it until the rocker reaches the opening unlatch position, whereupon the opening-side catch is disengaged, and the opening-side spring drives the bellcrank in pivoting movement towards its open position, thereby driving the actuating element of the switch rapidly toward a closed position thereof. During the opening and closing operations, the inertia of the components, and particularly the inertia of the bellcrank, helps to limit the velocity of the mechanism. Thus, the springs can be powerful enough to overcome any binding in the actuator itself or in the switch, thereby assuring reliable operation, without causing the mechanism to reach destructive speeds if such binding does not occur. The inertia of the components helps to distribute the stored energy of the springs over the entire opening and closing motion. During the beginning part of each opening or closing movement, the spring driving the movement is just beginning to relax from its fully-deformed condition, and therefore provides the maximum driving force. As the movement continues, the energy of the spring is converted to kinetic energy of the moving components. In the latter portion of the stroke, the spring is partially relaxed and therefore provides a lesser driving force. However, the kinetic energy stored in the moving components helps to drive the motion during this latter portion of the stroke. This allows reliable operation with smaller springs than would be necessary otherwise, and thus helps to make the mechanism compact.

Desirably, the components are arranged so that the opening-side spring does not fully relax during movement of the bellcrank to its open position, whereas the closing-side spring does not fully relax during movement of the bellcrank to its closed position. Thus, one of the springs continues to drive the bellcrank in opening or closing movement until the end of the movement; the bellcrank and other components connected to it need not coast through any portion of their motion. This helps to assure that the mechanism will not stall before the end of the movement.

Most preferably, the opening-side attachment point of the bellcrank and the rocker are disposed on one side of the plane defined by the bellcrank pivot axis and rocker pivot axis, referred to as the opening side of the plane, whereas the closing-side attachment points of the bellcrank and rocker are disposed on the opposite, closing side of the plane. The opening-side attachment point of the bellcrank moves rearwardly during opening movement of the bellcrank , whereas the closing-side attachment point moves rearwardly during closing movement of the bellcrank. The closing-side attachment point of the rocker moves rearwardly during pivoting movement toward the full closed position, whereas the opening-side attachment point moves rearwardly during pivoting movement of the rocker towards the full closed position. Thus, the closing-side and opening-side springs may be tension springs, such as massive coil springs. When the rocker is moved while the bellcrank is restrained by one of the catches, one of the springs will be stretched, and the other spring will be relaxed.

Most preferably, the bellcrank includes a pair of elements spaced apart from one another and the rocker includes a pair of elements spaced apart from one another in directions parallel to the pivot axes. The elements of the bellcrank and of the rocker cooperatively define a closing-side channel on the closing side of the plane and an opening-side channel on the opening side of the plane, the springs are received in the channels. This arrangement provides a particularly compact assembly. Moreover, the elements of the rocker and bellcrank guide and constrain the springs during the rapid movement of the bellcrank.

It is particularly desirable to guide and constrain each spring when that spring is slack. That is, the opening-side spring should be guided during the closing movement of the bellcrank impelled by the closing-side spring, and vice-versa. The elements of the bellcrank and the rocker intermesh with one another so as to form substantially continuous walls bounding the opening-side channel when the rocker is in the closing unlatch position and the rocker is in the open position thereof, and so as to form substantially continuous walls bounding the closing-side channel when the rocker is in the opening-unlatch position and the bellcrank is in said closed position thereof. Thus, the continuous walls will constrain the opening spring during closing movement of said bellcrank and restrain the closing spring during opening movement of said bellcrank.

The mounting means desirably includes nonuniform linkage means for linking the bellcrank to the actuating element of the switch so as to provide a nonuniform ratio between movement of the actuating element and movement of the bellcrank. Desirably, each increment of bellcrank movement produces a relatively small movement of the actuating element when the bellcrank is adjacent its closed position and produces a relatively large movement of the actuating element when the bellcrank is adjacent its open position. This allows the bellcrank to seat the moving contact of the switch with a reasonable closing velocity to minimize impact, but with a high force to assure closure. The nonuniform linkage means may include a plurality of links connected to one another, to the bellcrank and to the frame so that the bellcrank, frame and links cooperatively constitute a four-bar linkage.

Other objects and advantages of this invention will be better understood by those skilled in the art with reference to the accompanying drawings taken with the description which follows and in which:

DETAILED DESCRIPTION OF THE PREFERRED EMBODIMENTS

Figure 1:
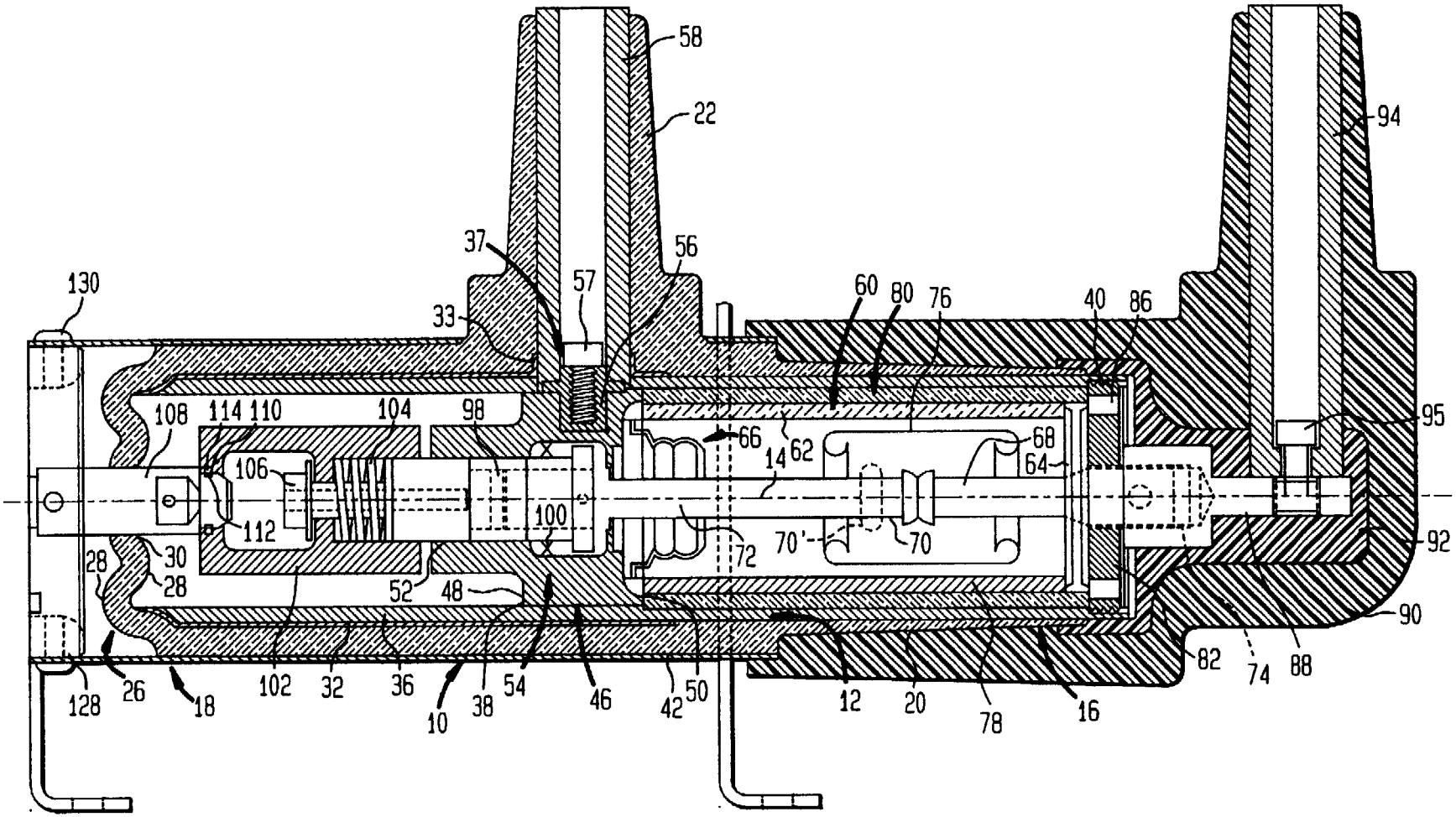
FIG. 1 is a fragmentary sectional view depicting a portion of a switch.

The switch depicted in FIG. 1 is a high-voltage switch as described in the aforementioned Luzzi application. The structure of the switch itself forms no part of the present invention; it is set forth herein solely for completeness. As used in this disclosure with reference to apparatus, the term "high voltage" means apparatus which is adapted to operate at a nominal system voltage above 3 kv. Thus, the term "high voltage" includes equipment suitable for use in electric utility service, such as in systems operating at nominal voltages of about 3 kv to about 38 kv, commonly referred to as "distribution" systems, as well as equipment for use in "transmission" systems, operating at nominal voltages above about 38 kv. The switch includes a housing 10 formed from a dielectric elastomer which is vulcanized under heat and pressure, such as ethylene propylene diene monomer (EPDM) elastomer. The housing defines an elongated bore 12 extending in endwise directions parallel to an axis 14. The housing has a fixed end 16 and a second, opposite end 18, referred to herein as the operating end. For reasons discussed below, the direction parallel to axis 14 along fixed end 16 is referred to herein as the closing endwise direction, whereas the opposite endwise direction, towards operating end 18 is referred to as the opening endwise direction. The housing defines a tapered bushing 20 at the fixed end and a further tapered bushing 22 extending perpendicular to the endwise axis. Bushing 22 has a tubular metallic current-carrying element extending through bushing 22 to bore 12 in a direction perpendicular to axis 14. The portion of housing 10 disposed between tapered bushing 20 and operating end 18 has a generally cylindrical exterior surface, so that the wall of the housing in this region is generally in the form of a cylindrical tube.

Housing 10 further includes a diaphragm 26 formed integrally with the other portions of the housing. Diaphragm 26 has a peripheral portion joining the tubular wall of the housing, a central portion 30 adjacent the axis 14 of the housing and annular convolutions 28 between the peripheral and central portions. Thus, although the peripheral portion of the diaphragm is fixed to the housing wall, the central portion 30 is free to move relative to the remainder of the housing upon flexure of convolutions 28.

Diaphragm 26 is thick enough to provide full voltage withstand capability. That is, the thickness of diaphragm 26 is selected so that the diaphragm will withstand the maximum voltage to be imposed between the current-carrying elements of the switch and ground during service or during fault conditions. For example, in a switch designed to operate at a nominal 25 KV phase-to-phase the diaphragm and other parts intended to provide full voltage withstand capability should be capable of withstanding at least about 14.4 KV continuously.

The housing is provided with an electrically conductive insert 32 formed from a mixture of the same elastomer used for the remainder of the housing and an electrically conductive material such as carbon black. Insert 32 covers the interior wall of bore 12 from diaphragm 26 to a point beyond bore 12. Insert 32 further extend radially inwardly for a short distance along the interior surface of diaphragm 26. The insert also has a short tubular section 33 extending along the exterior of the current-carrying element 58.

A rigid, tubular reinforcing element 36 extends substantially the entire length of housing 10 and bore 12. Reinforcing element 36 is formed from a dielectric material having high physical strength such as fiber reinforced thermosetting polymers, fiber reinforced thermoplastic polymers, and high strength polymers. Among the materials which can be used are fiberglass reinforced epoxy; polyamides; polyvinyl chloride and ultra high molecular weight polyethylene. The reinforcing element is provided with an annular shoulder 38 facing towards fixed end 16. Shoulder 38 faces in the closing endwise direction towards fixed end 16. Reinforcing element 36 protrudes slightly beyond the tip of conical portion 20 at the fixed end 16. The reinforcing element is provided with internal threads 40 at the fixed end of the device. The reinforcing element has a hole 37 aligned with the bore of bushing 22.

A tubular exterior support element 42 closely overlies the exterior surface of housing 10 in the regions of the housing adjacent the operating end 10. The exterior support further extends in the opening endwise direction beyond the operating end 18 of the housing. Exterior support element 42 is formed from a rigid, electrically conductive material such as stainless steel or another metal. Bushing 22 extends from the housing through a hole 46 in the exterior support.

Exterior support 42 is in intimate, void-free contact with the outside of housing 10, and is securely bonded to the dielectric elastomer of the housing. Likewise, the semiconducting lining 32 is intimately bonded to the dielectric elastomer. Reinforcing element 36 is in intimate, void-free contact with insert 32 over one portion of its length, adjacent operating end 18 and with the dielectric elastomer of the housing over the remainder of its length.

These components are fabricated by insert molding. Thus, reinforcing element 36 is placed on an internal mandrel commonly referred to as a core. The core and reinforcing element are disposed within a mold cavity. The core has a face with grooves corresponding to convolutions 28. A further core extends through hole 37 in the reinforcing element. A mixture of elastomer and carbon is injected into the mold around the reinforcing element and cores and cured under heat and pressure to form the insert. The assembly is then transferred to different mold having the shape of the housing 10. The exterior support element is also disposed within the mold, so that the insert, reinforcing element and core contained therein are disposed within the exterior support element. Current-carrying element 58 is also positioned in the mold. The dielectric elastomer is then injected into the mold around the reinforcing element and insert, and within the exterior support element 42. The elastomer is maintained under heat and pressure by using the conditions normally employed for localization of EPDM. To promote bonding, the interior surface of exterior support element 42, and the outer surface of reinforcing element 36 may be treated with conventional adhesion promoting agents. The molding process forms a permanent, void-free assemblage of the support element, insert, dielectric elastomer housing and exterior support element. The sub-assembly is then assembled with the other components discussed below.

The switch further includes an operating end buttress 46. The operating end buttress is formed from a metallic, electrically conductive material, preferably copper or a copper alloy. The operating end buttress has a first face 48 facing towards the operating end of the device and engaged with the shoulder 38 of the reinforcing element. The operating end buttress also has a second face 50 facing towards fixed end 16. A bore 52 extends through the operating end buttress and is substantially coaxial with axis 14 of the housing and reinforcing element. Bore 52 has an enlarged section 54. The operating end buttress also has a threaded fitting 56. A bolt 57 is disposed within current carrying element 58 and engages the threaded fitting 56. As further discussed below, the operating end buttress serves as a terminal for passage of current through the switch. The bolt 57 serves to maintain electrical continuity between the current carrying element 58 and buttress 46.

A contact assembly 60 is disposed between the operating end buttress 46 and the fixed end 16 of the device. Contact assembly 60 includes a tubular ceramic bottle 62 with a metallic fixed end closure 64 disposed at one end of the bottle and a further, operating end closure 66 disposed at the opposite, operating end of the bottle. Operating end closure 66 includes a flexible, extensible metallic bellows. A fixed contact 68 is mounted to the fixed end closure 64 and projects into bottle 62, whereas a moveable or operating-end contact 70 is mounted to the bellows of the operating end closure 66. The assembly further includes a rod-like operating element 72 disposed on the outside of bellows 66 which forms an extension of the moveable contact. Likewise, a threaded fixed end stub contact 74 is formed integrally with the fixed end contact 68 and projects outwardly beyond the fixed end closure 64. The contact assembly 60 further includes a metallic shield 76 surrounding portions of the contacts, the shield being supported within the housing by a metallic frame 78 extending through bottle 62. For this purpose, bottle 62 may be formed in sections, and both sections may be joined to the metallic frame. Bottle 62 is hermetically sealed. Thus, the joint between the end closures, contacts and bottle are gas-tight.

The interior space within bottle 62, surrounding the contacts has a controlled atmosphere therein. As used in this disclosure, the term "controlled atmosphere" means an atmosphere other than air at normal atmospheric pressure. Most preferably, the atmosphere within bottle 62 is under a subatmospheric pressure. The composition of the atmosphere may also differ from normal air. Arc-suppressing gases such as $SF_6$ may be present within the bottle. The entire contact assembly 60 may be a conventional, controlled-atmosphere contact assembly of the type commercially available from numerous sources. One such contact assembly is available under the designation WL-35590 from the Cutler-Hammer Company of Horseheads, N.Y.

The exterior diameter of bottle 62 is slightly less than the interior diameter of reinforcing element 36, so that there is an annular space between the outside of the bottle and the inside of the reinforcing element. This annular space is completely filled with a dielectric filler material 80, so as to provide a substantially void-free interface between the outside of the bottle and the inside of the reinforcing element. Filler 80 is formed from a dielectric material different from the dielectric material of housing 10. Most preferably, the dielectric filler 80 is a material which can be placed and brought to its final form without application of extreme temperatures or pressures. In service, the dielectric filler is not exposed to substantial mechanical stress. Therefore, the filler can be selected substantially without regard for its ability to withstand mechanical stress, abrasion and the like. The filler should have good dielectric strength. Preferred fillers include greases such as petroleum-based and silicone-based greases, gels such as silicone gels and curable elastomers of the type commonly referred to as room-temperature vulcanizing or "RTV" elastomers. Compatibility between the filler and the rubber of housing 10 should also be considered. Petroleum-based materials tend to swell EDPM. Therefore, if a petroleum-based filler is employed with an EPDM housing, the filler should be isolated from the housing during service. The dielectric reinforcing element can provide such isolation. Similarly, a silicone-based filler would tend to swell silicone rubber. The filler can also be made by deliberately swelling a rubber or other polymer. Thus, the space between the outside of bottle 62 and the inside of reinforcing element 36 can be loosely packed with a swellable polymer, such as EPDM or silicone rubber. The loose packing may be provided as a solid tube or mass; as granules or pellets; or in any other form such as a foam or sponge. A liquid capable of swelling the particular polymer used, such as mineral oil (petroleum oil) in the case of EPDM or silicone oil in the case of silicone rubber, is then introduced into the space. The liquid causes the polymer to swell and fill the entire space, thereby providing a void-free interface. This technique can be applied to voids in other electrical assemblies as well.

A metallic fixed end buttress 82 is engaged with the threads 40 of reinforcing element 36 and engaged with the fixed end closure 64 of the contact assembly. The fixed end buttress has a central bore receiving stub contact 74. Additional holes 86 are also provided in the fixed end buttress for use during the assembly process as described below. The fixed end buttress forces bottle 62 in the opening direction, towards the operating end 18, and holds the operating end of the bottle, as well as the periphery of operating end closure 66 in firm engagement with the second face 50 of the fixed end buttress 46. Thus, the bottle 62 is maintained under compression. A metallic second terminal 88 is attached to stub terminal 74 and hence to the fixed end 68 of the contact. The switch further includes a fixed end cover 90 formed from a dielectric elastomer and a fixed end electrical stress relief element 92 formed from a semiconducting elastomer. The fixed end cover 90 is positioned on housing 10 so that an internal taper in the fixed end cover is firmly engaged with conical seat 20 at the fixed end of the housing and so that the fixed end electrical stress release element surrounds second terminal 88, stub terminal 74, fixed end buttress 40 and the fixed end closure 64 of the contact assembly. The fixed end cap has a second tubular metallic current carrying element 94 mounted therein. A bolt 95 disposed in the current-carrying element is threadedly engaged with the second terminal 88.

A link 98 is slidably received in bore 52 of the operating end buttress 46. Link 98 is threadedly engaged with the operating element 72 of the contact assembly, and the threaded connection is locked against movement during service, as by a pin (not shown) extending through the threadedly engaged elements. An annular contact 100, of the type commonly referred to as a "louvered" contact, encircles link 98. Contact 100 has projections on its interior and exterior surfaces. The flexible projections on contact 100 bear on buttress 46 and on the link, thereby establishing a slidable electrical connection between the buttress and the link. Thus, the moveable contact 70 of the contact assembly is electrically connected to the first terminal or buttress 46. Alternatively, a flexible metallic strap, such as a braided copper strap, can be connected between link 98 and the first end buttress or first terminal 46. A yoke 102 is slidably engaged with link 98. A coil compression spring 104 is disposed between yoke 102 and the end of link 98, so that motion of the yoke in the closing direction, towards fixed end 16, to the right in FIG. 1, will be transmitted to link 98 and hence to moveable contact 70 by a spring. A bolt 106 is engaged with the link and the yoke so that motion of the yoke in the opposite, opening direction (to the length in FIG. 1) will be transmitted to link 98 and to the moveable contact 70 through bolt 106. Bolt 106 desirably applies a preload to spring 104, so that the spring remains in compression at all times.

An actuating element 108 formed from a strong, rigid dielectric material such as epoxy-reinforced fiberglass extends through diaphragm 26 at the center 30 thereof. Actuating element 108 is fixedly attached and bonded to the center of diaphragm 30. Preferably, actuating element 108 may be insert-molded into the diaphragm, by positioning the actuating element in the mold when the diaphragm is formed, during the aforementioned insert-molding process with a chemical bonding agent on the actuating element surface. Chemical bonding agents are well-known in the art of rubber molding. One suitable chemical bonding agent is sold under the registered trademark Chemlok 205. The actuating element itself, and the joint between the actuating element and the diaphragm should each have full voltage withstand capabilities.

Alternatively, the actuating element may be assembled to the diaphragm. This may be accomplished by molding the diaphragm with a hole smaller than the diameter of the actuating element, and then press-fitting the actuating element into the hole so as to form an intimate bond between the surface of the actuating element and the surrounding portions of the diaphragm. The actuating element may be provided with a shoulder on one side of the diaphragm and a fastener such as a nut and washer on the other side of the diaphragm. The fastener and the shoulder hold the central portion of the diaphragm in compression and hold the actuating element in fixed position relative to the diaphragm. Such a compression joint establishes a fixed, secure interface between the actuating element and the diaphragm.

Actuating element 108 is connected to yoke 102 by a snap-engageable connection. Thus, yoke 102 has a hole in the end of the yoke closest to the operating end of the device, and a groove 110 in the wall of such hole. Actuating element 108 has a circumferential groove 112 extending around it. A resilient snap ring 114 is engaged in these grooves so as to connect the actuating element to the link for movement therewith in endwise directions.

An actuator or driver assembly 120 in accordance with one embodiment of the present invention is attached to the other elements of the switch. The actuator 120 includes a driver frame 122 mounted to the housing 10 of the switch; a mobile element 124 connected to the actuating element 108 and a mechanism 126 for moving the mobile element in the opening and closing directions to move the actuating element and thereby move the mobile contact 70 (FIG. 1), thus opening and closing the switch.

Figure 2:
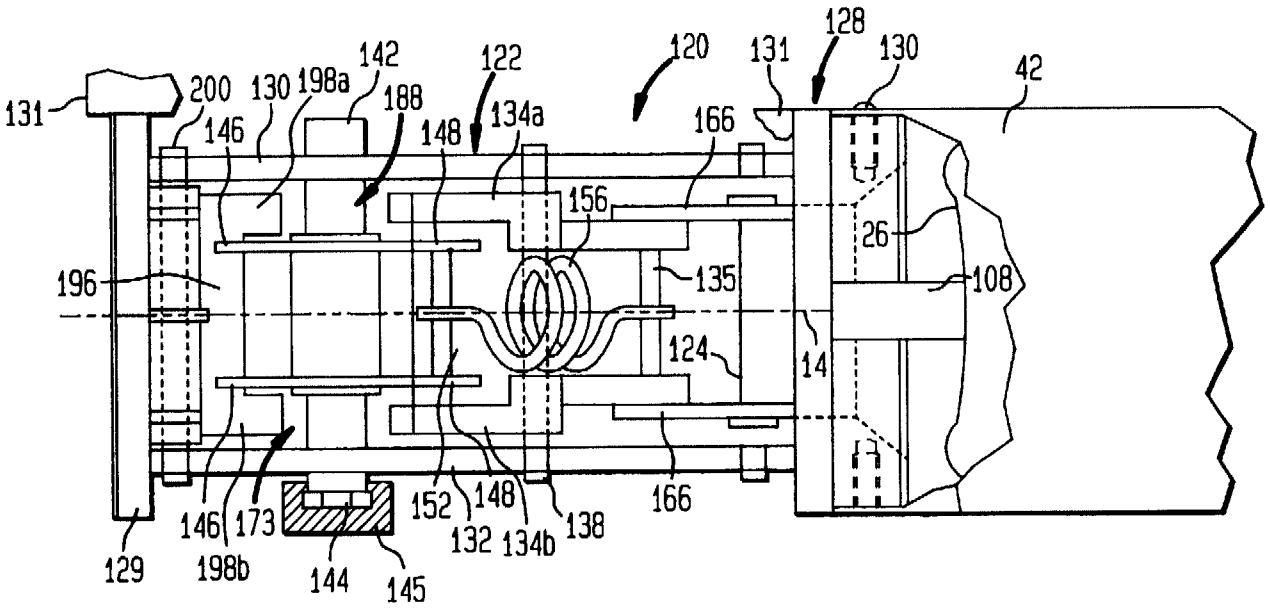
FIG. 2 is a fragmentary diagrammatic plan view depicting an actuator in accordance with one embodiment of the invention in assembly with the switch of FIG. 1, portions of the actuator being removed for clarity of illustration.

Driver frame 124 may be formed from stainless steel or other suitable corrosion resistant metal or other material. The driver frame has an annular collar 128 formed at a forward end and a further collar 129. Collar 128 is sized so that it fits within the tubular external support element 42 (FIG. 1). Machine screws 130 hold the collar 128 and hence driver frame 122 in assembled position relative to the external support element and thus relative to the elastomeric housing 10. A further cylindrical housing 131 (FIG. 2) fits over collar 129 and covers the mechanism of the driver. Only small portions of housing 131 are depicted in FIG. 2; the remainder is removed for clarity of illustration. Further, cover 131 is omitted in FIGS. 3–6.

The driver frame 122 and collar 128 are disposed adjacent the operating end 18 of housing 10. The outer end of actuating element 108 extends though the collar assembly 128 into the driver frame 122, where the actuating element is connected to the mobile element 124 of the driver assembly by an adjustable connection such as a threaded connection, provided with a pin or other suitable locking device for locking the adjustment.

Driver frame 122 includes a pair of plates 130 and 132 (FIG. 2). A pair of bellcrank elements **134*a* and 134*b* are mounted on a bellerank shaft 138 extending between plates 130, so that the bellcrank elements are pivotable relative to the frame about a bellcrank axis coincident with shaft 138. Bellcrank elements 138 are rigidly connected to one another by a plate 139 extending therebetween. An opening side pin 135 and a closing side pin 137 extend between the bellcrank elements 134 adjacent the forward end of the mechanism on opposite sides. As further discussed below, pins 135 and 137 form attachment points for connecting springs to the bellcrank. As best seen in FIGS. 3–6, each bellcrank element has a generally arcuate surface with a notch 140** therein.

An operating shaft 142 extends through plates 130 and 132 in bearings (not shown), so that the operating shaft is rotatable with respect to the driver frame. Operating shaft 142 has a polygonal head 144 on one end for engagement by an operating handle 145. A pair of cam plates 146 are fixedly mounted to operating shaft 142. The cam plates 146 cooperatively constitute a rocker. The rocker is mounted by shaft 142 for pivoting movement with respect to frame 122 about a rocker axis coincident with shaft 142. Rocker axis 142 is disposed rearwardly of bellcrank axis 138 but parallel thereto, so that the axes cooperatively define a common plane coincident with the central axis 14 of the switch. For convenience of reference, the region on one side of this plane (above the plane and above axis 14 in each of FIGS. 2–6) is referred to as lying on the opening side of the plane, whereas the region on the opposite side, below the plane and axis 14 as seen in FIGS. 2–6, is said to lie on the closing side of the plane.

Figure 3:
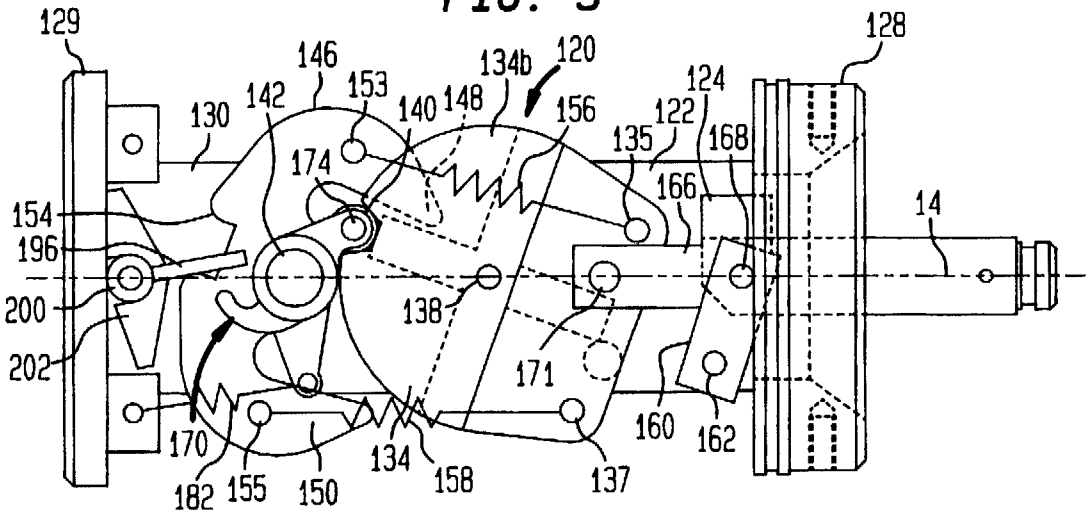
FIG. 3 is a diagrammatic elevational view of the actuator illustrated in FIG. 2.

Each cam plate of the rocker has a pair of main projections 148 and 150 (FIG. 4) extending in the forward direction, toward collar 128 and a pair of catch surfaces 152 and 154 (FIGS. 3 and 4) extending in the rearward direction. As best seen in FIGS. 2 and 3, the opening side projections 148 of cam plates 146 extend between bellcrank elements 134 when the mechanism is in the closed position illustrated in FIGS. 2 and 3. Closing side projections 150 similarly extend between the bellorank elements when the mechanism is in the open position illustrated in FIG. 5. An opening side pin or attachment point 153 extends between cam plates 146 of the rocker on the opening side of common, plane 14, adjacent the opening side projections of the plates. A closing side pin or attachment points 155 extends between the cam plates of rocker 146 adjacent the closing side projections 150.

An opening side main spring 156 extends between the opening side pin 135 of the bellcranks and opening side pin 153 of cam 146. As best seen in FIG. 2, opening side spring 156 is a large, powerful spring which substantially occupies the space between the bellcrank elements and the space between the projections of the cam plates. Also, the loops of spring 156 which are engaged with the pins have inside dimensions considerably larger than the pins themselves. A similar closing side spring 158 extends between the closing side pin 154 the closing side pin 155 of cam 146 and the closing side pin 137 of the bellcrank. Although closing spring 158 is depicted only schematically in FIGS. 3–6, it should be appreciated that the closing side spring is also a massive, powerful spring which occupies much of the space between the bellcrank elements and between the closing side projections 150 of the cam plates.

Figure 4:
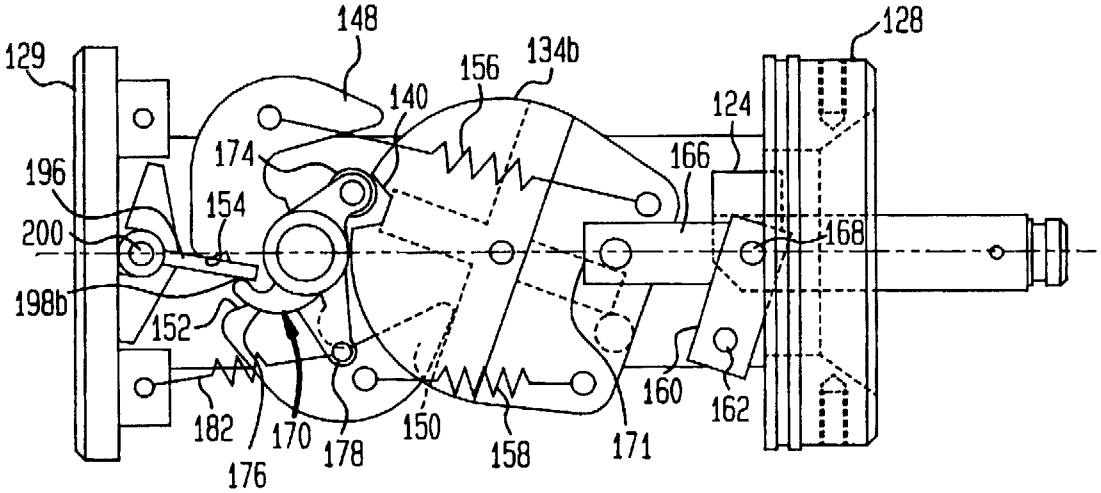
FIGS. 4 through 6 are views similar to FIG. 3 but depicting the actuator in different operating positions.

A pair of guide link plates 160 are pivotally mounted to the driver frame adjacent plates 130 and 132 on pins 162 (FIGS. 3 and 4). A pair of drive link plates 166 extend adjacent frame plates 130 and 132. A main pin 168 connects the guide link plates 162 to the drive link plates 166, and also connects the link plates to the mobile element 124 of the drive mechanism. Drive link plates 166 are connected by further pins 171 to the bellcrank elements. The driver frame 122, guide links 162, drive links 166 and bellcrank elements 134 constitute a mechanism of the type commonly referred to as a "four bar" linkage.

An opening catch 170 (FIGS. 3 and 4) is rotatably mounted on operating shaft 142. Opening catch 170 is disposed in a space 173 adjacent cam plate 146 and bellcrank plate **146*b*, on one side of the mechanism. Catch 172 is omitted for clarity of illustration in FIG. 2 and in FIGS. 5 and 6. Opening catch 170 has a roller-equipped tip 174. The opening catch 170 also has a finger 176 and a spring mount 178. A catch spring 182 is engaged between the spring mount 178 and the cap 129 of the driver frame. Spring 182 biases opening catch 170 in the clockwise direction as seen in FIGS. 3 and 4, and thus biases the tip 174 of the catch into engagement with the arcuate surface of bellcrank element 134*b***.

A similar closing catch 186 (FIGS. 5 and 6) is rotatably mounted to the operating shaft 142 in space 188 (FIG. 2) adjacent bellcrank element **134*a*. Closing catch 186 is omitted for clarity of illustration in FIG. 2 and FIGS. 3 and 4. Closing catch 186 has a roller equipped tip 190, spring arm 192 and finger 194 similar to the corresponding elements of the opening catch. Catch spring 196 is engaged between spring arm 192 of the closing catch and cap 129 of the frame so as to bias the closing catch in the counterclockwise direction about shaft 142 and thus bias the tip 190 into engagement with bellcrank plate 134*a*. A flipper plate 196 having a pair of projections 198*a* and 198*b* (FIG. 2) is pivotally mounted to the driver frame on an intermediate shaft 200 extending between the frame plate 130 and 132. Pivoting movement of the plate is limited by stops 202 (FIGS. 3–6). Shafts 200 is parallel and coplanar with shafts 138 and 142**, and thus with the bellcrank and pivot axes.

In operation, the switch is connected in the circuit through current-carrying elements 58 and 94, and hence through terminals 46 and 88. Insert 32 is electrically connected to the first terminal 46. Thus, the insert is maintained at the same electrical potential as the first terminal or buttress 46. Link 98 and yoke 102 are at the same potential, and hence there is no potential gradient within the space enclosed by insert 32. Stress relief element 92 likewise maintains all of the components at the fixed end of the switch at the potential of second terminal 88.

In the position illustrated in FIGS. 1–3, the switch is closed. Pins 171 are disposed on axis 14 in alignment with the bellcrank shaft 138 and pin 168. The tip of 174 of the opening catch is engaged in the slot 140 of bellcrank element **138*b*. The rocker or cam plates 146 lies in its full closed position. To open the switch, the lineman engages handle 145 (FIG. 2) and turns the handle so as to pivot rocker or cam plates 146 counterclockwise as seen in FIGS. 3 and 4. As the lineman turns the rocker, the opening-side attachment point or pin 153 of the bellcrank moves in the rearward direction, whereas the closing-side attachment point or pin 155 moves in the forward direction. The bellcrank 134 is retained in position by catch 174. Thus, the opening spring 156 is stretched between pins 153 and 135, whereas closing spring 158 is relaxed. With continued motion of the rocker, the mechanism reaches the opening unlatch position illustrated in FIG. 4. In this position, the closing side projections 150 of the cam plates are engaged between the bellcrank elements 134. Thus, the cam plates and the bellcrank elements form a substantially continuous channel, with walls bounding the closing spring 158** on opposite sides thereof.

As the rocker 146 is moved from the full closed position of FIG. 3 to the opening unlatch position of FIG. 4, the rocker passes through an opening start position just before reaching the opening unlatch position. When the rocker reaches the opening start position, surface 154 on the cam plate 146 of the rocker engages flipper plate 196, and turns it in the clockwise direction about shaft 200. A projection on plate 196 engages the finger 176 of the opening catch, thereby forcing the opening catch in the counterclockwise direction against the bias of spring 182. The roller tip 174 of the catch is lifted out of slot 140 in bellcrank **134*b*. It should be appreciated that the catch surface 154 does not engage the flipper plate, and the flipper plate does not engage finger 176 until cams 146 are almost at the end of their counterclockwise rotary movement. The entire action of lifting the roller tip 174 out of slot 140 occurs over a very short rotational movement of rocker 146**, between the opening start position and the opening unlatch position.

Figure 5:
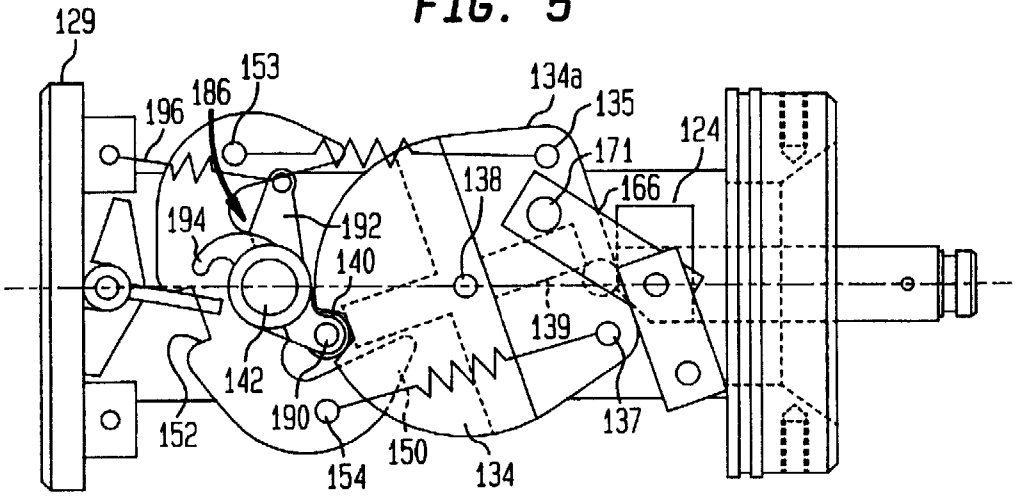
Figure 6:
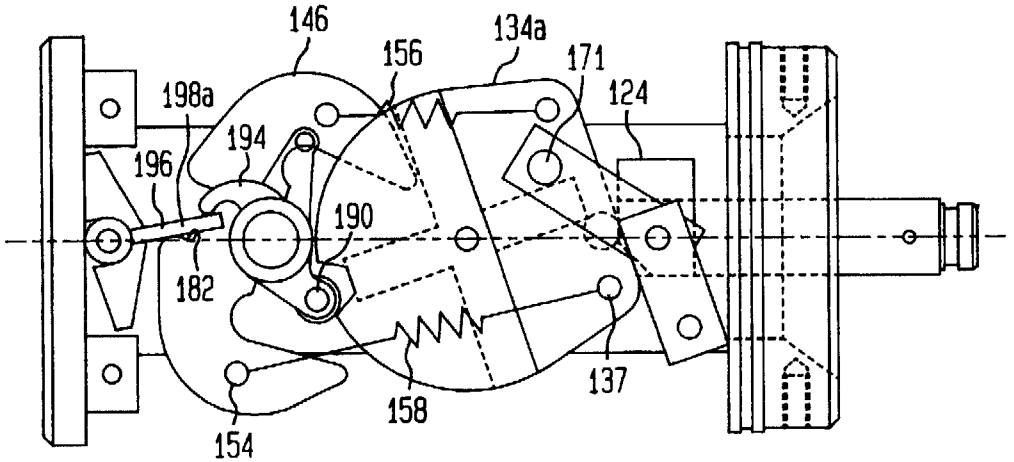

When the roller tip 174 clears slot 140, opening spring 156 drives the bell crank 134 in rotation in a closing direction, counterclockwise as seen in FIGS. 3 and 4, until the bellcrank elements reach the position illustrated in FIG. 5. The components are dimensioned so that the opening spring remains under tension throughout the opening motion of the bellcrank. Thus, the rearward motion or opening throw of the opening-side attachment pin 153 on the rocker, from the fully closed position of FIG. 3 to the fully-open position of FIG. 5, is greater than the rearward motion or opening stroke of the opening-side attachment pin 135 on the bellcrank. Conversely, the forward motion of the closing-side pin 154 of the rocker is greater than the forward motion of the corresponding pin 137 of the bellcrank. Therefore, the closing-side spring is brought to a slack condition and remains slack when the bellcrank reaches the open position illustrated in FIG. 5. Any excess motion of pin 154 beyond that required to bring the closing-side spring to a fully slack condition is taken up by movement of the pin within the end loop of the spring; the closing-side spring is not placed in compression. The continued presence of tension in the opening-side spring throughout the opening motion helps to assure that the mechanism does not stall at some intermediate position during the opening stroke. In effect, the end loops and pins serve as a lost-motion linkage connected in series with opening-side spring 156 between the opening-side attachment points of the bellcrank and rocker and a further lost-motion linkage connected in series with the closing-side spring 158 between the closing-side attachment points of the bellcrank and rocker.

Pins 171 on the bellcrank pull the drive links 166 with them and hence moves the mobile element 124 of the drive mechanism in the opening direction (to be left as seen in the drawings). Thus, the mobile element pulls the actuating element 108, yoke 102 (FIG. 1), bolt 106, link 98 and operating element 72 in the opening direction. Thus, the movable contact 70 is moved to its open position. This movement occurs suddenly, thereby minimizing any possibility of arcing between the contacts. As the bellcrank elements move to the open position of FIG. 5, the tip 190 of the closing catch 186 engages in the slot 140 of bellcrank element 134*a*, under the influence of spring 196. This locks the mechanism in the open position illustrated in FIG. 5.

The closing action operates in a similar fashion, but with a reverse rotation. Thus, the lineman actuates the handle so as to turn the operating shaft and the rocker 146 in the closing or clockwise direction allowing the opening spring 156 to relax and stretching closing spring 158, as the closing side pin 154 of the rocker moves rearwardly. As the mechanism approaches the closing unlatch position of FIG. 6, it passes through a closing start position at which catch surface 152 on the cams engages flipper plate 196, so that a projection 198*a* of the plate engages the finger 194 of the closing catch, thereby lifting the roller tip 190 out of engagement with slot 140 in bellcrank element 134*a*. When the rocker reaches the closing unlatch position and tip 190 clears the slot, closing spring 158 pulls the closing side attachment pin 137 of the bellcrank rearwardly, and thus drives the bellcrank 134*a* in rotation in a closing direction, clockwise as seen in the drawings, until the bellcrank reaches the closed position illustrated in FIG. 3. As the bellcrank turns to the closed position, it forces pin 171 and hence the drive link 166 and mobile element 124 in the closing direction, thus forcing all of the other elements of the switch and ultimately movable contact 70 in the closing direction, to the closed position depicted in FIG. 1. The closing-side spring remains under tension throughout the closing cycle, and remains under tension when the bellcrank reaches the closed position. To provide such tension, the rearward movement or throw of the closing-side attachment point 154 on the rocker is greater than the rearward movement or stroke of the closing-side attachment point 137 on the rocker.

The closing rotation of cam plate 40 is arrested by stops 202 and the flipper plate 196. The closing movement of the bell cranks(from the position of FIG. 6 to the position of FIG. 3) brings pins 171 into alignment with pins 138 and 168. As pins 171 approaches this position, the linkage provides a substantial mechanical advantage so that the mobile element 124 is driven in the closing direction with substantial force. The connection between mobile element 124 and actuating element 108 is adjusted so that movable contact 70 engages fixed contact 68 slightly before closing movement of the driver mechanism is completed. The final motion of the driver mechanism, after contact engagement, is accommodated by sliding movement of yoke 102 (FIG. 1) relative to link 98, against the bias of spring 104. This movement minimizes mechanical shock loading applied to the contacts.

The loads which are applied to the contact assembly during closing motion are transmitted through fixed contact 68, end closure 64 and fixed end buttress 82 to reinforcing element 36 via threaded connection 40. Essentially none of these loads are applied to bottle 62. The loads applied to reinforcing element 36 tend to move it in the closing direction (to the right in FIG. 1) relative to the driver frame. However, exterior reinforcing element 42 is fixed to the driver frame by collar 128. The exterior reinforcing element restrains housing 10, which in turn restrains the reinforcing element. The interior and exterior reinforcing elements 36 and 42 are telescoped together, and engage housing 10 over large surface areas, with only a thin annular portion of the elastomer of the housing interposed between them. This forms a rigid, stress-resistant joint which firmly supports the reinforcing element 36 against motion.

The driver mechanism or actuator discussed above provides significant advantages. It moves the contact rapidly between opened and closed positions so as to minimize arcing. The driver mechanism is extremely compact. The entire mechanism is accommodated in a tubular housing of essentially the same diameter as the switch exterior reinforcing element. An O-ring or other conventional seals (not shown) can be provided between driver tubular housing 131, collars 128 and 129 and so as to provide a weather- tight seal protecting the elements of the driver mechanism. The driver housing 131 is also provided with a hole (not shown) for passage of the handle 145. This hole may be provided with appropriate seals.

Although the actuator can be made in essentially any size, to fit any high-voltage switch, one useful actuator has opening and closing main springs with spring constants of about 160 lb/in or 175.2N/m, and has a bellcrank with a moment of inertia about the bellcrank axis of about 3.3 lb-in$^2$ or 0.0009 Kg-m$^2$. Each main spring is stretched by about 0.97 in or 25 mm during movement of the rocker to the opening-unlatch or closing-unlatch position. The distance between the bellcrank axis and the rocker axis is about 2 in or 51 mm, whereas the radial distance from the rocker axis 142 to each of the opening-side and closing side attach pins 153 and 154 is about 1.39 in or 35 mm. The radial distance from the bellcrank axis 138 to each of the opening-side and closing-side attach pins 135 and 137 is about 1.57 in or 40 mm.

As will be appreciated, numerous variations and combinations of the features discussed above can be utilized without departing from the present invention as defined by the claims. For example, switches other than those disclosed in the Luzzi Application may be utilized in conjunction with the actuator. Also, the rocker 146 of the actuator may be driven in pivoting motion by an automatic device rather than by manual operation. The lost-motion arrangement utilizing the spring end loops can be replaced by other forms of lost-motion linkages. Accordingly, the forgoing description of the preferred embodiment should be taken by way of illustration rather than by way of limitation of the invention.

What is claimed is:

1. An actuator for a high voltage switch comprising:

(a) a driver frame defining a bellerank pivot axis and a rocker pivot axis parallel to the bellcrank pivot axis but spaced in a rearward direction therefrom;

(b) a bellcrank mounted to the frame for pivoting movement around the bellcrank pivot axis, the bellcrank element having an opening-side attachment and a closing-side attachment, the bellcrank being pivotable between an open position and a closed position;

(c) a rocker mounted to the frame for pivoting movement around said rocker pivot axis, the rocker having an opening-side attachment point, the rocker being pivotable between a full closed position and a full open position;

(d) an opening-side spring connected between the opening-side attachment points of said rocker and said bellcrank, and a closing-side spring connected between the closing-side attachment points of said rocker and said bellcrank so that said opening side spring will be deformed and energy will be stored therein upon movement of the rocker from its full closed position towards its full open position while the bellcrank remains in its closed position, and so that said closing side spring will be deformed and energy will be stored therein upon movement of the rocker from its full open position towards its full closed position while the bellcrank remains in its open position;

(e) an opening-side catch for restraining said bellcrank against opening pivotal movement when said bellcrank is in said closed position thereof and a closing-side catch for restraining said bellcrank against closing pivotal movement when said bellcrank is in said open position thereof;

(f) catch release means for disengaging said opening-side catch when said rocker reaches an opening unlatch position close to said full-open position during opening movement thereof and disengaging said closing-side catch when said rocker reaches a closing unlatch position close to said full-close position during closing movement thereof; and (g) mounting means for connecting said frame to a body of a high-voltage switch and connecting said bellcrank to an actuating element of the switch, whereby when the rocker pivots in closing movement said closing-side spring will be deformed until the rocker reaches the closing unlatch position, whereupon the closing-side spring will drive the bellcrank in pivoting movement towards its closed position and drive the actuating element of the switch rapidly toward a closed position thereof, and when the rocker pivots in opening movement said opening-side spring will be deformed until the rocker reaches the opening unlatch position, whereupon the opening-side spring will drive the bellcrank in pivoting movement towards its open position and drive the actuating element of the switch rapidly toward a closed position thereof.

2. An actuator as claimed in claim 1 wherein the pivot axes define a common plane, said opening-side attachments of said rocker and said bellcrank being disposed on an opening side of the common plane, said closing-side attachments of said rocker and said bellcrank being disposed on a closing side opposite from said opening side, the opening-side attachment of the bellcrank moving rearwardly during pivoting movement of the bellcrank toward said open position and said closing-side attachment of the bellcrank moving rearwardly during pivoting movement of the bellcrank towards said closed, the closing-side attachment of the rocker moving rearwardly during pivoting movement of the rocker toward its full closed position, the opening-side attachment of the rocker moving rearwardly during pivoting movement of the rocker towards its full open position.

3. An actuator as claimed in claim 2 wherein said bellcrank includes a pair of elements spaced apart from one another and said rocker includes a pair of elements spaced apart from one another, said plates of said bellcrank and said plates of said rocker cooperatively defining a closing-side channel on said closing side of said plane and an opening-side channel on said opening side of said plane, said springs being received in said channels.

4. An actuator as claimed in claim 3 wherein each said spring is a coil tension spring.

5. An actuator as claimed in claim 4 wherein said elements of said bellcrank and said rocker intermesh with one another so as to form substantially continuous walls on opposite sides of said opening-side channel when said rocker is in said closing unlatch position, and so as to form substantially continuous walls on opposite sides of said closing-side channel when said rocker is in said opening-unlatch position, whereby said continuous walls will constrain said opening spring during closing movement of said bellcrank and constrain said closing spring during opening movement of said bellcrank.

6. An actuator as claimed in claim 1 wherein said catch release means is arranged to leave said opening catch engaged during opening movement of said rocker from said full-closed position to an opening start position close to said opening unlatch position, and to leave the closing catch engaged during closing movement of said rocker from said full-open position to a closing start position close to said opening unlatch position.

7. An actuator as claimed in claim 6 wherein said catch release means includes a flipper movably mounted to said frame so that the flipper will displace the opening catch upon movement relative to the frame in a first direction and displace the closing catch upon movement in a second direction, said rocker including an opening projection adapted to engage the flipper and move the flipper in said first direction when the rocker reaches the opening-start position in opening movement and a closing projection spaced apart from the opening projection, the closing projection engaging the flipper when the rocker reaches the closing-start position in closing movement.

8. An actuator as claimed in claim 7 wherein said catches are pivotally mounted to said frame for movement about said rocker axis, and wherein said flipper is pivotally mounted to said frame on a flipper axis parallel to said rocker axis.

9. An actuator as claimed in claim 8 wherein said bellcrank defines at least one generally arcuate surface having a notch therein and each said catch includes a tip engagable with one said notch.

10. An actuator as claimed in claim 1 wherein said mounting means includes nonuniform linkage means for linking the bellcrank to the actuating element of the switch so as to provide a nonuniform ratio between movement of the actuating element and movement of the bellcrank, such that each increment of bellcrank movement produces a relatively small movement of the actuating element when the bellcrank is adjacent its closed position and produces a relatively large movement of the actuating element when the bellcrank is adjacent its open position.

11. An actuator as claimed in claim 10 wherein said nonuniform linkage means includes a plurality of links connected to one another, to said bellcrank and said frame so that the bellcrank, frame and links cooperatively constitute a four-bar linkage.

12. An actuator as claimed in claim 1 wherein said rocker, said bellcrank and said springs are constructed and arranged so that said opening-side spring continues to urge said bellcrank toward said open position during the entire opening movement thereof and so that said closing-side spring continues to urge said bellcrank toward said closed position during the entire closing movement thereof.

13. An actuator as claimed in claim 12 wherein said springs are tension springs, said opening-side attachment of said rocker moves through an opening throw distance during movement of the rocker from its full-closed position to its full open position and said opening-side attachment of said bellcrank moves through an opening stroke distance, said opening throw distance being greater than said opening stroke distance, and wherein said closing-side attachment of said rocker moves through a closing throw distance during movement of the rocker from its full-closed position to its full open position and said closing-side attachment of said bellcrank moves through a closing stroke distance, said closing throw distance being greater than said closing stroke distance.

14. An actuator as claimed in claim 13 further comprising an opening-side lost-motion mechanism connected in series with said opening-side spring between said opening-side attachments and a closing-side lost-motion mechanism connected in series with said closing-side spring between said closing-side attachments.

15. An actuator as claimed in claim 14 wherein each said spring includes at least one end loop having an inside diameter, at least one of said opening-side attachments including a pin received in one said end loop of the opening-side spring and having an outside diameter smaller than the inside diameter of such end loop, at least one of said closing-side attachments includes a pin received in one said end loop of the closing side spring and having an outside diameter smaller than the inside diameter of such end loop, said lost-motion mechanism including said end loops and said pins.

16. An actuator as claimed in claim 1 further comprising a generally tubular housing surrounding and enclosing the aforesaid components of the actuator.

17. An actuator as claimed in claim 16 wherein said frame includes a pair of plates extending forwardly and rearwardly within said housing, said plates being transverse to said axes and spaced apart from one another, said bellcrank and said rocker being disposed between said plates.

18. An actuator as claimed in claim 17 wherein said frame further includes a pair of collars at forward and rearward ends of said plates, said tubular housing being supported on said collars.

* * * * *